United States Patent [19]

Staten et al.

[11] Patent Number: 4,779,542

[45] Date of Patent: Oct. 25, 1988

[54] FOLD AND ROLL STAGING

[75] Inventors: Kenneth E. Staten, Clare; Orley D. Rogers, Farwell, both of Mich.

[73] Assignee: Stageright Corporation, Clare, Mich.

[21] Appl. No.: 80,301

[22] Filed: Jul. 31, 1987

[51] Int. Cl.[4] ..... A47B 3/00

[52] U.S. Cl. ..... 108/112; 108/113

[58] Field of Search ..... 108/112, 113

[56] References Cited

U.S. PATENT DOCUMENTS

| | | | |
|---|---|---|---|
| 1,674,554 | 6/1928 | Leamy | 108/112 X |
| 2,901,304 | 8/1959 | Fihe | 108/112 |
| 2,978,754 | 4/1961 | Wilson | 108/112 |
| 3,680,942 | 8/1972 | Davis | 108/112 X |
| 3,777,674 | 12/1973 | Parsons | 108/113 |
| 4,005,898 | 2/1977 | Way | 108/112 X |
| 4,570,751 | 2/1986 | Kleu | 108/112 X |
| 4,580,776 | 4/1986 | Burkinshaw | 108/112 X |

FOREIGN PATENT DOCUMENTS

| | | | |
|---|---|---|---|
| 2041216 | 9/1980 | United Kingdom | 108/113 |

*Primary Examiner*—Peter A. Aschenbrenner

*Attorney, Agent, or Firm*—Barnes, Kisselle, Raisch, Choate, Whittemore & Hulbert

[57] ABSTRACT

A portable and foldable platform stage assembly has two support panels movable from a collapsed position with panels closely adjacent each other to an operative position with the panels in a single plane, the inner edges in substantial contact. Roller wheels move from a storage position when the panels are in operative position to a floor contacting position when the panels are collapsed for storage or movement. Outer legs move from a storage position to a vertical operative position when the panels are shifted to operative position. A central support frame pivotally supports the inner edges of the platform panels in the two positions with shaped spaced support links which provide positive support in the operative position and adapt to a receiving position when the panels are moved to storage positions.

7 Claims, 3 Drawing Sheets

FOLD AND ROLL STAGING

FIELD OF INVENTION

Portable equipment for forming stage platforms for musical and dramatic presentations.

BACKGROUND AND FEATURES OF THE INVENTION

Many educational and religious organizations cannot provide permanent stage platforms in the physical facilities available. When visiting choruses or dramatic groups are invited for a performance, it is possible to rent staging equipment for a temporary set-up after which the equipment is dismantled and returned. In addition, when visiting musical stars come into auditoriums, stadiums, or arenas, frequently it is necessary to set up an extensive stage area not normally available.

To meet these needs, it is desirable to have staging equipment which can be easily stored and transported. It is also preferable to have equipment which can be folded into compact units to save space for storage and trucking. It is also desirable to have stage units which can be readily handled by one, or, at most, two persons so that large set-up crews are not needed.

It is an object of the present invention to provide a foldable staging unit which is easily moved around by one person, which can be stored in a compact form and readily transported, and which can be easily set up to provide a solid stable unit which meets all the requirements of safety when used for holding groups of people, musical instruments, and the like.

Other objects and features of the invention will be set forth in the following description and claims in which the principles of the invention are set forth together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
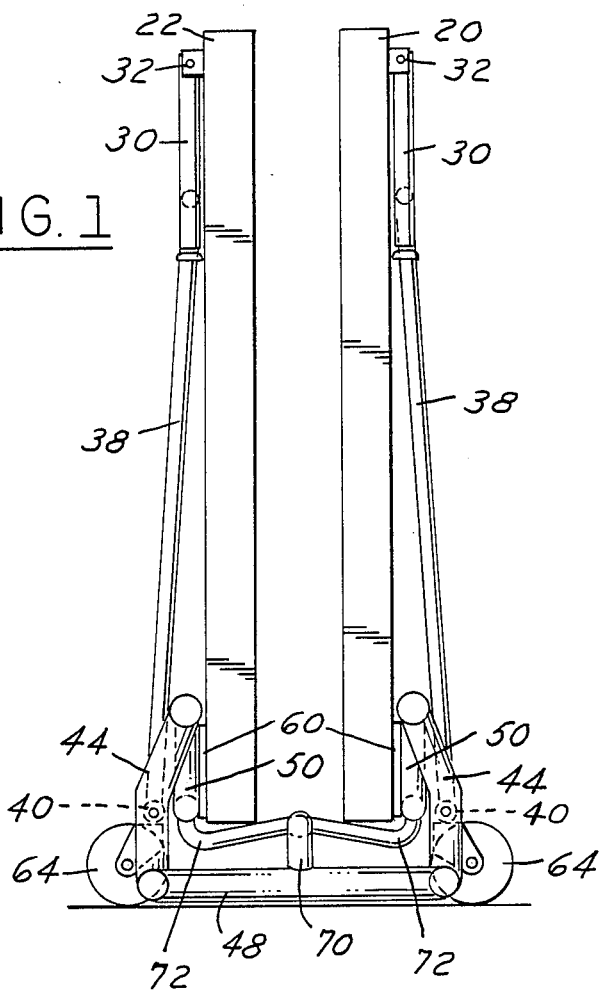
FIG. 1, an elevation view of a folded stage unit.
Figure 2:
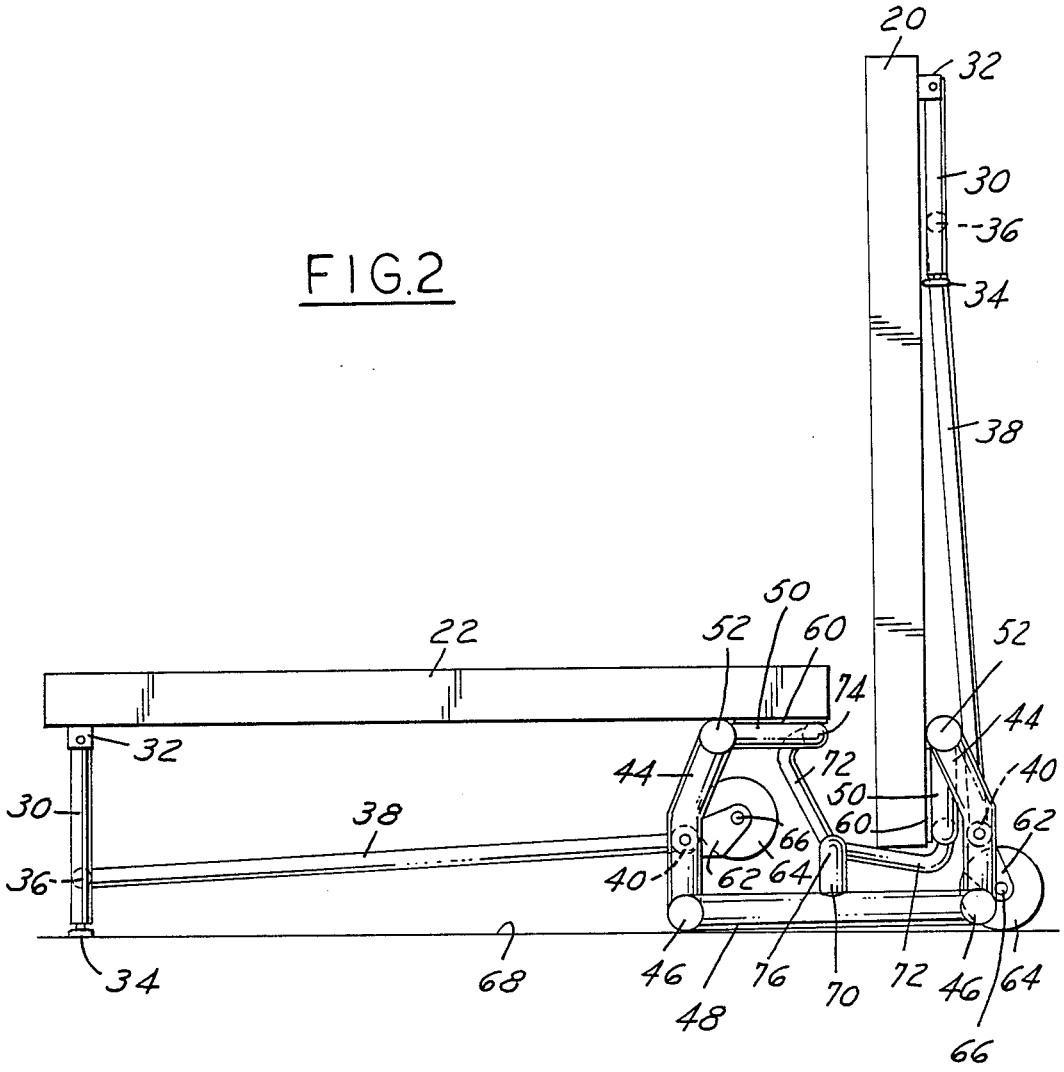
FIG. 2, an elevation view of a stage unit with one section open.

In FIG. 1, a folded stage unit is illustrated with two platform panel elements 20 and 22 connected by a special hinging system which positions two rollers at the base to facilitate moving the folded unit to and from storage or trucking facilities. In FIG. 2, the platform element 20 is still in upright position while element 22 is lowered to an operative position. Each unit has similar support systems on each side of the platform elements and only one side will be described in detail. The panel elements 20, 22 are constructed in a conventional manner of plywood, or honeycomb reinforced panels of suitable load bearing quality.

Outer legs 30 are hinged at 32 to the bottom outer end of the platform elements and each has an end 34 to contact the support floor. These ends 34 may be suitably padded and may be extensible if different heights are desired.

Each outer leg 30 is pivotally connected at 36 to an operating and stabilizing link 38 which at an inner end is connected pivotally at 40 to a central support frame having vertical main support leg elements 44 pivotally connected at the bottom ends at 46 to a cross brace member 48. The leg elements are bent inwardly at the pivot point 40. At the top end of the legs 44 a short arm 50 is pivotally connected at 52. This arm is positioned horizontally below the inner edge of the platform element 22 as shown in FIG. 2 when the platform element is in operative position. A plate 60 secures the arm 50 to the bottom surface of the platform elements 20 and 22 adjacent the inner edges.

Each link 38 has a bifurcate bracket extension 62 which mounts a roller wheel 64 on a short axle 66. As illustrated in FIG. 2, the wheel 62 in the open side below platform element 22 is spaced away from the support plane 68. On the right side in conjunction in the upright element 20 the roller 64 is in contact with the support plane.

Reverting to the central support frame, the legs 44 and the cross brace members 48 are pivotally secured together, and suitable lateral members extend transversely of the platform elements to rigidly connect the opposed frames and outer legs on each side of the platform elements. The cross brace member 48 has a short vertical upright post 70. Dogleg struts or links 72 are pivoted at the short end at 74 to the inner end of arm 50 and at the long end at 76 to the upright post 70.

Figure 5:
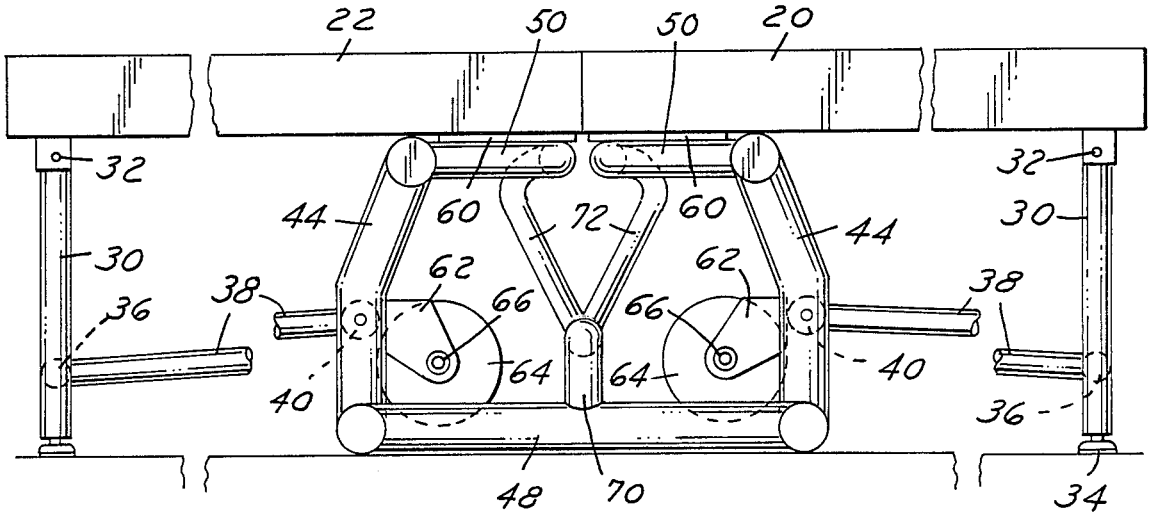
FIG. 5, an enlarged view of the central support system for the unit in a fully open position.
Figure 3:
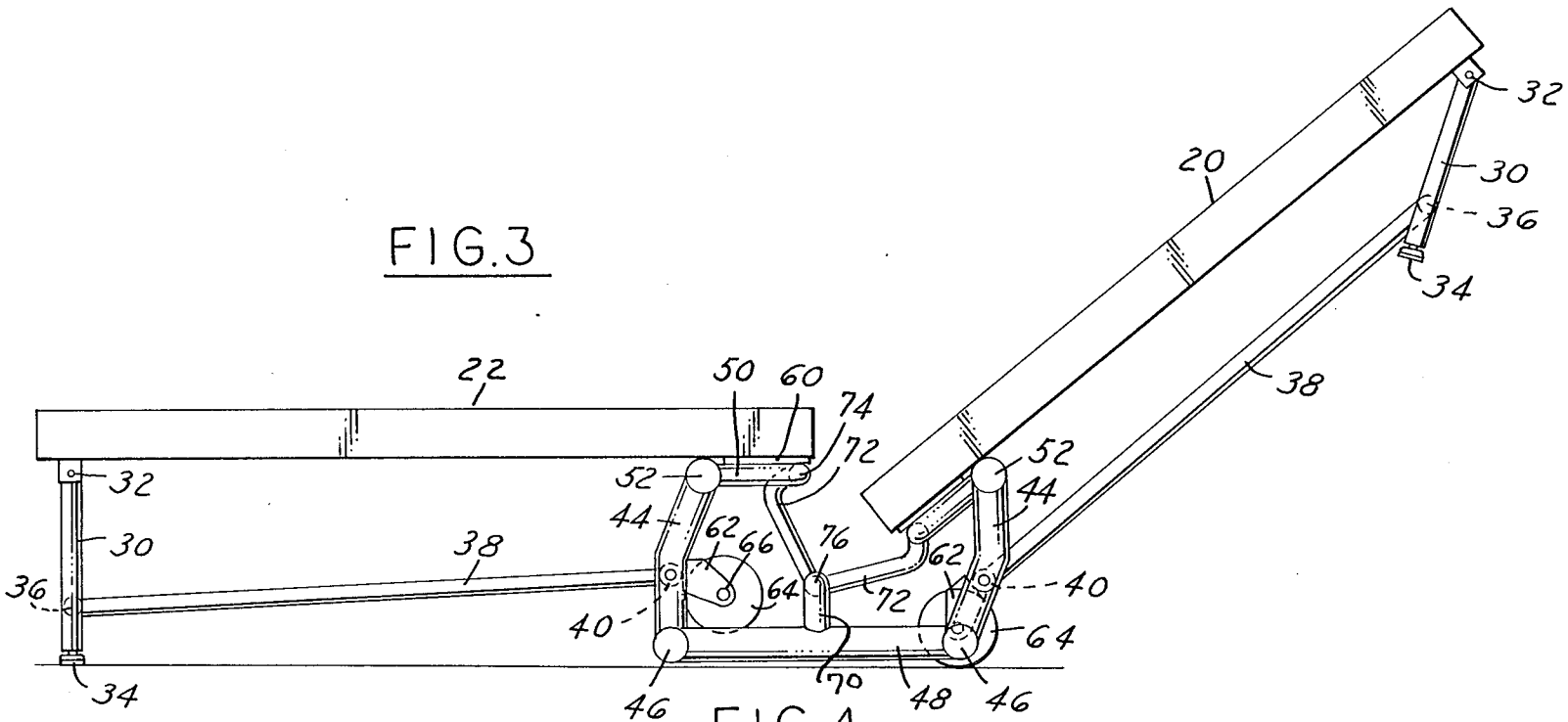
FIG. 3, an elevation view similar to FIG. 2 with one section open and a second section in a transition position.
Figure 4:
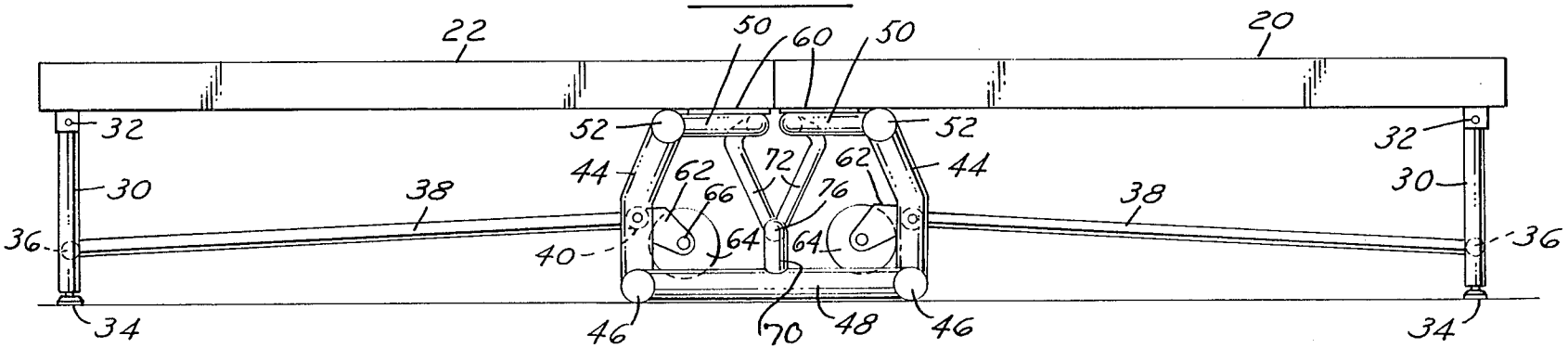
FIG. 4, a stage unit entirely opened to operative position.

In FIG. 3, the parts are shown with platform element 22 in open position and element 20 moved from the storage position to a 45° position to illustrate how the moving support parts function. FIG. 4 illustrates the fully operative position with both platform panels horizontally positioned with the inner edges close together. FIG. 5 shows the central support frame in a larger size, again in fully open position.

It wil be appreciated that in the opening or closing movement, the links 38 will act on the outer legs to move them respectively to the vertical support position or to the folded position shown in FIG. 1. Also, in FIG. 1 and at the right side of FIG. 2, the importance of the shape of legs 44 and dogleg links 72 is evident. The inner edges of the panels 20, 22 drop into the recess formed by the dogleg links 72, and the bend-in legs 44 permits the nestling of the arms 50 and cross member associated with the spaced frames. In the storage position, the roller wheels 64 contact the support surface to permit easy movement of the collapsed assembly to and from the selected site. In the operative position, the wheels 62 are in a nonfunctioning storage position.

In the operative position of the panels (FIGS. 4 and 5), they are supported centrally by the legs 44 and links 72, each in turn supported in substantially parallel position on the frame base 48 with the short vertical post 70 supporting the lower end of link 72. In the folded position shown at the right side of FIG. 2, the panels are supported mainly by legs 44.

If vertical extensions are desired to raise the level of the entire unit, retractible extensions can readily be installed at 34 on legs 30 and to the base end of legs 44.

The swinging mount on the two platform panels has a significant function in the operation of the assembly. In essence, there is a parallelogram mount with the main leg 44 and the secondary leg 72 operating simultaneously. The secondary leg is shorter than the main leg. With this system, when a platform panel is lifted in the initial movement to move it to a storage position, it actually moves lineally away from the other panel so there is ample clearance to avoid interference of the inner edges of the panels as the panel is lifted. At the end of the upward stroke, the shape of the legs 44 and 72 function as described to allow the panel edge to move into the lowered storage position. The leg 44 starts in a substantially vertical position in storage position and ends in the same position when in platform position. This makes it possible to provide a lock on this main leg in either position.

What is claimed is:

1. A fold and roll platform assembly comprising:

(a) a pair of platform panels, (b) outer legs on each said panels to support the outer edges in operative position, (c) a central support frame to support the panels in storage position when said panels are disposed parallel to each other or in operative position when positioned inner edge to inner edge in a common plane, said support frame comprising:

(1) a base member on said frame extending in the same direction and spaced from said common plane, (2) main support legs at each end of said frame extending upwardly and pivotally connected to said respective panels adjacent the respective inner edges of said panels, and pivotally connected to said base member, (3) secondary support legs spaced from said main support legs each pivotally connected to said respective panels and said base member, said main and secondary support legs being simultaneously movable to allow said panels to shift from a vertical upright storage position to a horizontal operative position, said main and secondary support legs acting in substantially parallel position to support the inner edges of said panels on said base member of said frame.

2. A fold and roll platform assembly as defined in claim 1 in which operative links respectively connect said outer legs with said main support legs to move said outer legs from a storage position adjacent a panel to an operative position perpendicular to a panel when said panels are moved from a storage position to an operative position.

3. A fold and roll platform assembly as defined in claim 2 in which roller wheels are mounted on extensions of said respective operative links to shift from a surface contacting position to a storage position when said panels are moved on said frame from a storage position to an operative position.

4. A fold and roll platform assembly as defined in claim 1 in which said secondary support legs are formed in a dogleg shape to provide a concave clearance area for the inner edge of a panel as it moves to a storage position.

5. A fold and roll platform assembly as defined in claim 1 in which each said main support leg has a bend to provide a storage space for one end of each said secondary support leg when said panels are in storage position.

6. A fold and roll platform assembly as defined in claim 1 in which a short arm is positioned and secured adjacent the inner edge of each said platform panel, and the upper ends of said main support legs and said secondary support legs are pivotally attached to said arm at spaced positions.

7. A fold and roll platform assembly as defined in claim 6 in which each said main support leg has a bend to provide a storage space for said short arm and one end of said secondary leg when said panels are in storage position.

* * * * *